United States Patent [19]

Hartman

[11] 4,275,863

[45] Jun. 30, 1981

[54] BOCK HOLDER

[76] Inventor: Don A. Hartman, 4715 SE. Adam-Apt. 936A, Bartlesville, Okla. 74003

[21] Appl. No.: 428

[22] Filed: Jan. 2, 1979

[51] Int. Cl.[3] ..... A47B 97/04

[52] U.S. Cl. ..... 248/448; 248/452

[58] Field of Search ..... 248/448, 449, 460, 453, 248/452, 451, 149, 172; 403/289

[56] References Cited

U.S. PATENT DOCUMENTS

| | | | |
|---|---|---|---|
| 632,384 | 9/1899 | Welch | 248/449 |
| 939,942 | 11/1909 | Brauchli | 248/452 |
| 1,033,660 | 7/1912 | Beecher | 248/452 |
| 1,695,767 | 12/1928 | Johnson | 248/449 |
| 1,953,560 | 4/1934 | Johnson | 248/449 |
| 2,090,000 | 8/1937 | Hager et al. | 248/460 |
| 2,716,565 | 8/1955 | Harper et al. | 403/289 |
| 3,140,558 | 7/1964 | Cassidy | 248/452 X |
| 3,176,953 | 4/1965 | Magers | 248/451 |
| 3,341,166 | 9/1967 | Forrester | 248/448 |
| 3,638,898 | 2/1972 | Shaw | 248/448 |

*Primary Examiner*—Francis K. Zugel

*Attorney, Agent, or Firm*—James H. Chafin

[57] ABSTRACT

A book holder having a backrest portion which connects a base plate for supporting the lower edge of an open book and a top plate which is adjustable to contact the upper edge of the open book, and inwardly facing frictional pad members secured to the base and top plate for preventing the accidental page turning of the book.

4 Claims, 6 Drawing Figures

BOCK HOLDER

BACKGROUND OF THE INVENTION

1. Field of the Invention

The present invention relates to book holders and more particularly, but not by way of limitation to a holder for music books having soft covers, the holder being supportable by a music stand, piano music rest or the like.

2. History of the Prior Art

Much of the music produced today is bound in soft cover books whereby at the spine of the book, the pages are glued together along the back edges. When these books are new and often after the books are fairly well used, it is practically impossible to get the book to set on a music stand or the music rest plate of the piano without having pages accidentally turn. Musicians have a constant problem of not only keeping the music book in an open position but also turning pages during the playing of a particular musical composition.

Piano players historically have used extra books on the piano music rest plate that are placed in contact with the open pages to keep the book open to a certain position. When it comes time to change the page, the musician then must use both hands to turn the page and resecure the music to the desired open position.

Another technique that is used is to actually have an assistant sitting on the piano bench or nearby which must keep track of the music and do the page turning for the musician.

Various music book holders have been developed in the past but most use some variation of a pair of spring-loaded pivotal arm members which may be placed across the open pages of the book to hold it in an open position. While this solves the problem of keeping the book open to the desired page location, it is still extremely difficult to turn the pages without an assistant or without removing both hands from the musical instrument in order to effect the page turning.

The same general problem exists in cases where a person is hospitalized or attempting to read a book from a bed, it is next to impossible to keep the book open to the desired page location without grapsing the book with both hands.

SUMMARY OF THE PRESENT INVENTION

The present invention provides a book holder which is particularly designed and constructed to support a book at its top and bottom edges to be able to keep the book open to the desired page location and at the same time facilitate the turning of pages in the book with minimal effort and with only the use of one hand.

The present book holder device while being developed primarily for use as a music book holder, is adaptable for use with practically any type of soft cover book and in some cases may work with a hard cover book.

The device comprises an elongated base plate member which has an upwardly extending backrest portion secured along the rear edge of the base plate. This backrest member also comprises one or more vertical slots along the rear edge thereof.

The music holder further comprises a top plate member which is positioned directly above the base plate, the rear edge of the top plate member having elongated rods or slats which are slidably and frictionally engageable with the slots of the backrest member.

A plurality of inwardly facing frictional pad members, usually made of a soft flexible material such as urethane foam, is provided along the upper surface of the base plate member and the lower surface of the top plate member. When a book is placed in an open position on the base plate member, the lower edge of the book pages sets on the frictional pads. The pads tend to prevent the pages from closing or turning accidentally. The top plate member is then adjusted downwardly so that similar pads spaced along the bottom surface thereof come into contact with the upper edge of the open book. These frictional pads or pressure pads then prevent the pages from accidentally turning while at the same time when the user is ready to turn a page, he simply turns the page in an ordinary manner and when he moves the right hand page to the left hand position he applies enough pressure to slip that page between the pressure pads thereby again keeping the book at the new desired page location.

It can readily be seen that the base plate member may be adapted to set on the music rest plate of a piano, on a music stand, on any type of book holder or even be allowed to lie flat on the table surface.

It can further be seen that this device will be extremely useful as a book rest in libraries, corporations and in any field where it might be desirable to study the book, periodical, magazine or other manuscript for the comfort of the user or when it is desirable for the user to have his hands free for making notes, dictating or the like.

DESCRIPTION OF THE DRAWINGS

Other and further advantageous features of the present invention will hereinafter more fully appear in connection with the detailed description of the drawings in which.

DESCRIPTION OF THE PREFERRED EMBODIMENT

Figure 1:
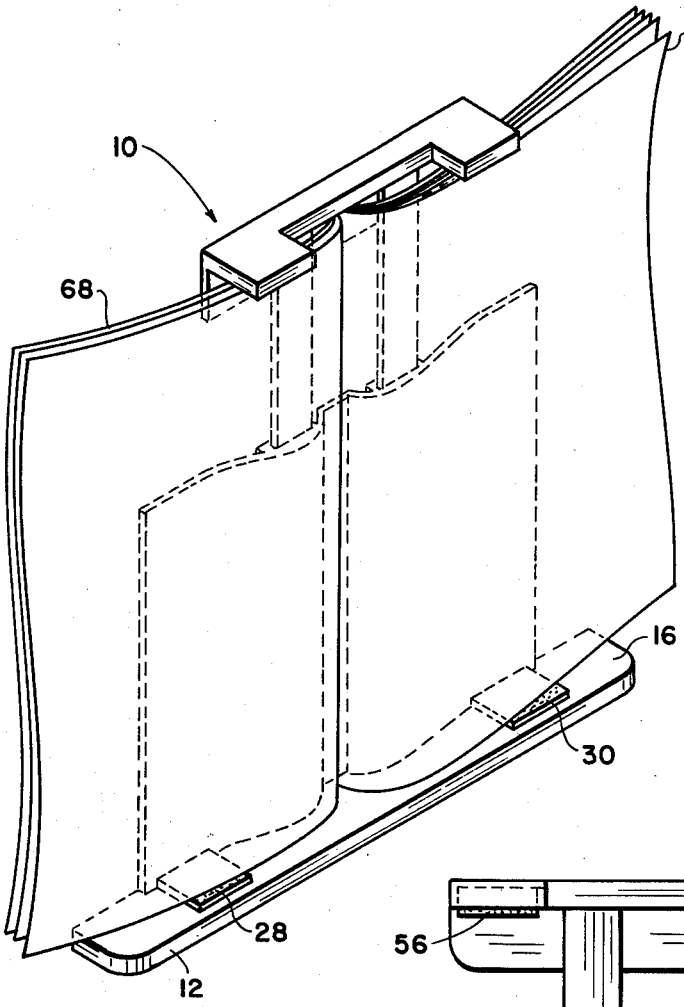
FIG. 1 is a perspective view of a book holder embodying the present invention and having an open book mounted thereon.
Figure 2:
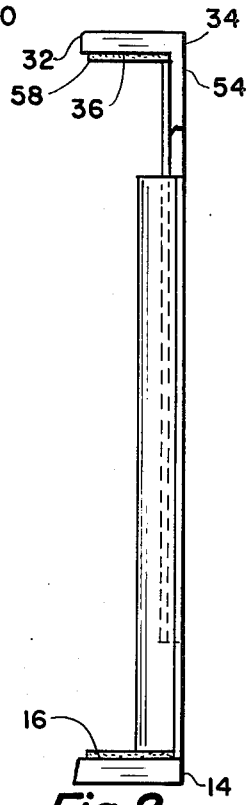
FIG. 2 is a side elevational view of the book holder of FIG. 1.

Referring to the drawings in detail, reference character 10 generally indicates a book holder embodying the present invention. The book holder 10 comprises an elongated substantially flat base plate member 12 having one edge thereof designated the rear edge 14 and one surface thereof designated as the inner surface 16. A substantially rectangular backrest member 18 is secured to the upper surface 16 of the face plate adjacent the rear edge portion 14 thereof. A front surface 20 of the backrest 18 is shaped to the contours of the typical paperback or soft back book when open and having an elongated flattened portion 22 through the center thereof to receive the back edge or spine of the book thereagainst. It is noted that the backrest member 18 can be made from a plastic type material and can be injection molded as an integral part of the base plate member 12.

The back rest 18 further comprises a pair of spaced elongated parallel rectangular slots 24 and 26 along the back surface thereof, the slots being located on either side of the flattened backrest portion 22.

Again the material surrounding the elongated rectangular slots 24 and 26 may be molded from the same plastic piece as that of the backrest 18. A spaced pair of rectangular friction pads or pressure pads 28 and 30 are secured to the inner surface 16 of the base plate 12. These pressure pads are to be constructed of a very soft flexible material such as urethane foam for a purpose that will be hereinafter set forth.

The holder also comprises an elongated substantially flat top or end plate 32 also having one edge designated as the rear edge, reference character 34 and an inner surface designated by reference character 36.

A pair of spaced parallel elongated slat members 38 and 40 are secured to the inner surface 36 of the end plate 32 near the rear edge 34 thereof. The cross-sectional shape of said slats 38 and 40 are substantially the same as the cross-sectional shapes of the elongated slots 24 and 26 of the backrest members 18.

Figure 4:
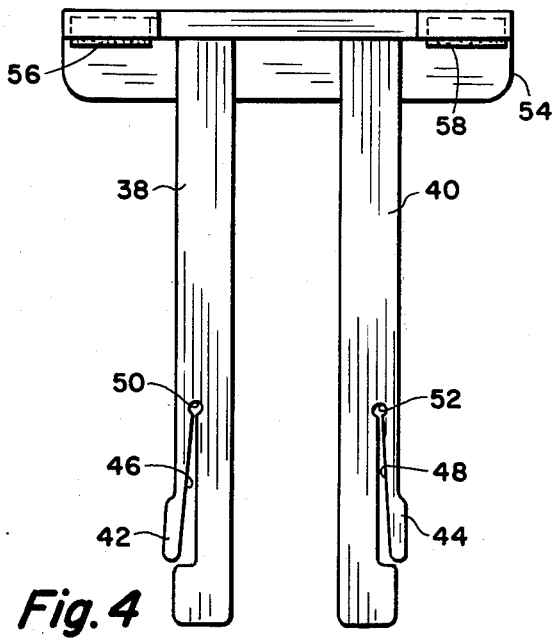
FIG. 4 is a detailed front elevational view of the top plate member of the book holder of FIG. 1.
Figure 6:
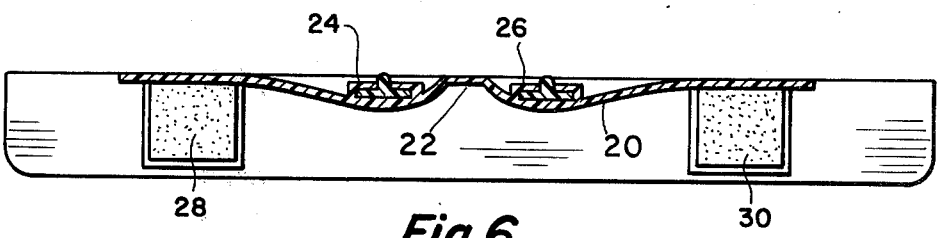
FIG. 6 is a top sectional view of the holder of FIG. 1 taken along the broken lines 6—6 of FIG. 3.
Figure 5:
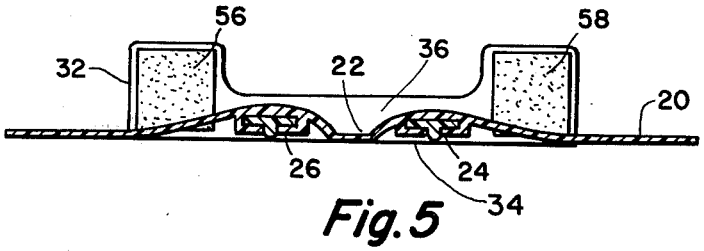
FIG. 5 is a bottom sectional view of the top plate member of FIG. 1 taken along the broken lines 5—5 of FIG. 3.

Near the outer ends of the slats 38, 40 are a pair of outwardly extending spring clips 42 and 44 respectively which may be pressed inwardly to conform to the size of the slots 24 and 26. It can be seen that these spring-loaded clip members 42 and 44 may be made as an integral part of the slats by forming elongated apertures 46 and 48 in each slat member terminating in bores 50 and 52, the cooperating of such slats and bores forming a space for receiving the clip members 42 and 44 therein. Naturally, the spring loading action comes about by the stiffness of the material adjacent the slats 46 and 48 which causes the clip members to tend to spring outwardly as shown in FIG. 4. A substantially rectangular back plate 54 is secured along the rear edge 34 of the end plate and is also secured to the inner end of the slats 38 and 40 and provides stiffening therefor.

The inner surface 36 of the end plate 32 is provided with a pair of spaced friction or pressure pads 56 and 58, again these pads being of soft pliable material such as urethane foam. It is also noted that the pads 56 and 58 are set slightly closer together than the base plate pads 28 and 30. All of the pads 28 and 30, 56 and 58 may be either glued to the inner surfaces of the plate members or, for greater stability, may be inset into recesses 60, 62, 64 and 66 as shown in FIG. 3.

Figure 3:
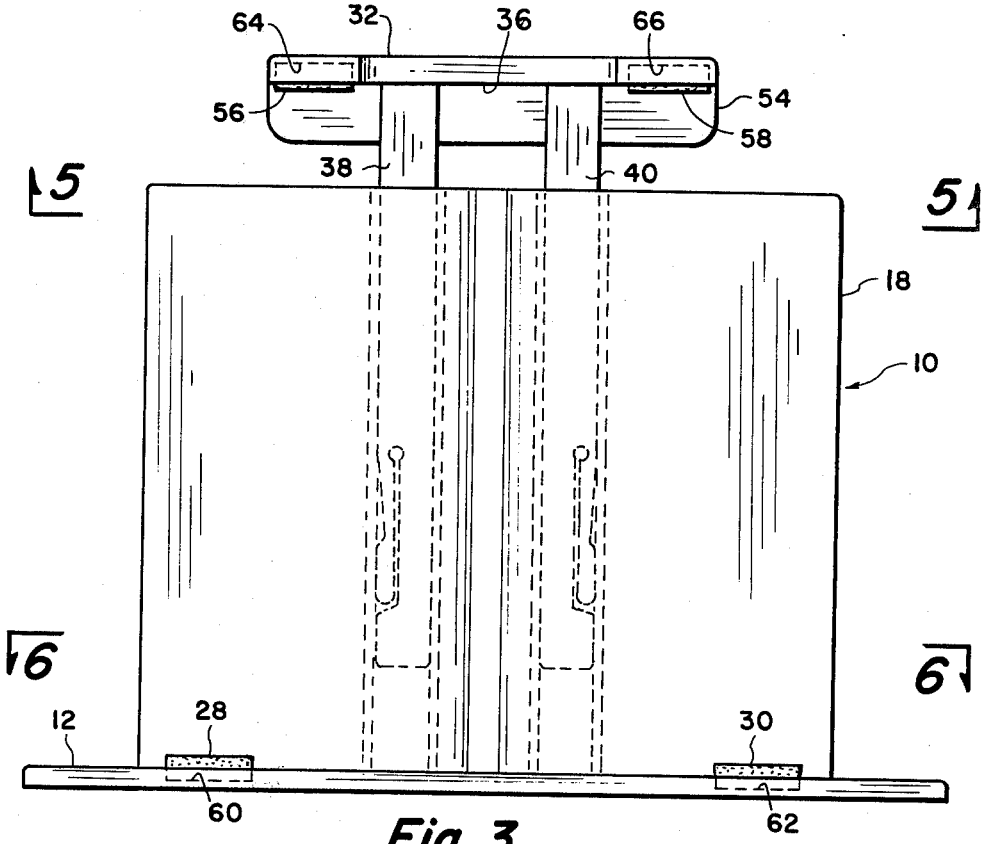
FIG. 3 is a front elevational view of the book holder of FIG. 1.

Referring to FIG. 3, it can be seen that the assembly of the book holder apparatus 10 is accomplished by depressing the clip members 42 and 44 and inserting the slats 38 and 40 into the elongated slots 24 and 26, respectively. The distance between the base plate 12 and the end plate 32 may be continuously adjusted by the location of the slats 38 and 40 within the slots 24 and 26, respectively. Any given position of the end plate may be maintained by the spring-loaded pressure of the clip members 42 and 44, again as shown in FIG. 3.

In use, a book such as the sketch in FIG. 1 designated by reference character 68 may be opened to a desired page location, the lower edge of the book resting on the base pads 28 and 30. The end plate 22 is then adjusted to bring the end plate pads 56 and 58 into contact with the upper edge of the book 68, all shown in FIG. 1.

The frictional characteristics of the urethane foam pads will maintain the book in an open position. When it is desirable to turn the page, one need merely to grasp the upper right corner of the page at 70 and pull that page over to the left side of the holder. The page may be easily pulled out of frictional contact from the pads 30 and 58 when turned over to the left side may be gently pushed into contact with the pads 28 and 56.

Whereas, the present invention has been described in particular relation to the drawings attached hereto, other and further modifications apart from those shown or suggested herein may be made within the spirit and scope of the invention.

For example, all of the parts shown herein may be made from a molded plastic configuration whereby the base member 12 and backrest member 18 may be made of one piece of plastic while the end plate 32, cross plate 54 and slats 38 and 40 may be made of a second piece of plastic. However, models may be made of substantially any durable materials such as wood or metal.

It is to be understood that the device hereinbefore described is usable with any type of soft back book such as magazines and periodicals and it is further understood that the pages of the book may be turned forward or backward grasping the pages at the top or bottom or by turning the pages in any customary manner.

It is further noted that whereas the invention has been described with a particular backrest and framework design including two parallel sliding slat members, that the device may be workable by utilizing a single sliding slat or rod with or without a contoured backrest.

What is claimed is:

1. A book holder comprising:

a horizontally disposed elongated base plate having front and rear edges;

a horizontally disposed elongated top plate having front and rear edges spaced above the base plate;

a frame secured between the rear edges of the base plate and the top plate said frame including means to vertically adjust the top plate with respect to the base plate; and a first pair of spaced apart upwardly facing friction pad members secured to the upper surface of the base plate and extending slightly above the base plate upper surface, and a second pair of spaced apart downwardly facing friction pad members secured to the lower surface of the top plate and extending slightly below the top plate lower surface, the top plate pad members being spaced closer together than the base plate pad members to facilitate manipulation of the pages of a book from the upper corners thereof, said pages being supported substantially only on said pad members thereby reducing drag when said pages are turned.

2. A book holder as set forth in claim 1 wherein said means for vertical adjustment comprises a first frame member secured to the base plate, said first frame comprising at least one vertically disposed slot aperture therein, and a second frame member secured to the top plate, said second frame member comprising an elongated slat member associated with each slot aperture and having a cross-sectional shape compatible with, and being slidably insertable within, said slot aperture, each slat member comprising a spring-loaded slide retainer clip made as an integral part thereof for frictionally engaging the inside surface of the slot aperture.

3. A book holder as set forth in claim 2 wherein the first frame member comprises a pair of spaced slot apertures and the second frame member comprises a pair of spaced parallel slat members which are slidably and frictionally receivable within said slot apertures.

4. A book holder as set forth in claim 2 and including a book rest member secured to the first frame member, said book rest member having a front surface comprising a vertically disposed central flat strip for receiving the spine of a soft back book thereagainst, and a pair of oppositely disposed curved surfaces on either side of the flat strip, said curved surfaces being compatible with the shape of a soft back book in an open position.

* * * * *

UNITED STATES PATENT AND TRADEMARK OFFICE

CERTIFICATE OF CORRECTION

PATENT NO. : 4,275,863

DATED : June 30, 1981

INVENTOR(S) : Don A. Hartman

It is certified that error appears in the above—identified patent and that said Letters Patent is hereby corrected as shown below:

Change the title of the patent both on the title page and on the first page of the specification from "BOCK HOLDER" to --BOOK HOLDER--.

Signed and Sealed this

*Twenty-second* Day of *September 1981*

[SEAL]

*Attest:*

GERALD J. MOSSINGHOFF

*Attesting Officer*

*Commissioner of Patents and Trademarks*